US010060674B2

(12) United States Patent
Hodges

(10) Patent No.: US 10,060,674 B2
(45) Date of Patent: Aug. 28, 2018

(54) PRODUCTION OF ETHANE FOR START-UP OF AN LNG TRAIN

(71) Applicant: Woodside Energy Technologies Pty Ltd., Perth (AU)

(72) Inventor: Derek William Hodges, Dianella (AU)

(73) Assignee: WOODSIDE ENERGY TECHNOLOGIES PTY LTD., Perth (AU)

( * ) Notice: Subject to any disclaimer, the term of this patent is extended or adjusted under 35 U.S.C. 154(b) by 658 days.

(21) Appl. No.: 14/027,726

(22) Filed: Sep. 16, 2013

(65) Prior Publication Data

US 2014/0075986 A1 Mar. 20, 2014

(30) Foreign Application Priority Data

Sep. 18, 2012 (AU) ..... 2012904065
Apr. 9, 2013 (AU) ..... 2013203120

(51) Int. Cl.

*F25J 3/06* (2006.01)
*F25J 1/00* (2006.01)
*F25J 1/02* (2006.01)

(52) U.S. Cl.

CPC ..... *F25J 3/0615* (2013.01); *F25J 1/0022* (2013.01); *F25J 1/0052* (2013.01); *F25J 1/0055* (2013.01); *F25J 1/025* (2013.01); *F25J 1/0216* (2013.01); *F25J 1/0247* (2013.01); *F25J 3/061* (2013.01); *F25J 3/064* (2013.01); *F25J 3/0635* (2013.01); *F25J 2215/62* (2013.01); *F25J 2220/64* (2013.01); *F25J 2260/20* (2013.01); *F25J 2270/12* (2013.01); *F25J 2270/60* (2013.01)

(58) Field of Classification Search

CPC ..... F25J 1/0247; F25J 1/025
See application file for complete search history.

(56) References Cited

U.S. PATENT DOCUMENTS

| | | | | |
|---|---|---|---|---|
| 3,593,535 | A * | 7/1971 | Gaumer, Jr. | F25J 1/0022 62/114 |
| 5,832,745 | A | 11/1998 | Klein Nagelvoort et al. | |
| 6,272,882 | B1 * | 8/2001 | Hodges | F25J 1/0022 62/613 |
| 6,370,910 | B1 | 4/2002 | Grootjans et al. | |
| 6,389,844 | B1 | 5/2002 | Klein Nagel Voort | |
| 7,219,512 | B1 | 5/2007 | Wilding et al. | |
| 2008/0016910 | A1 * | 1/2008 | Brostow | F25J 1/0022 62/630 |
| 2010/0293996 | A1 * | 11/2010 | Van Aken | F25J 1/0022 62/614 |
| 2010/0326133 | A1 * | 12/2010 | Beeby | F25J 1/0214 62/614 |
| 2011/0146342 | A1 * | 6/2011 | Sumner | C09K 5/042 62/619 |

OTHER PUBLICATIONS

Ransom, G. Pluto LNG plant start-up. Gas Technology Institute. May 15, 2012. Taken from http://www.gastechnology.org/Training/Documents/LNG17-proceedings/2-3-Gerard_Ransom.pdf.*

* cited by examiner

*Primary Examiner* — Tareq Alosh
(74) *Attorney, Agent, or Firm* — Edell, Shapiro & Finnan, LLC

(57) ABSTRACT

A process is described herein for the production of a selected quantity of ethane as a component of a production inventory of mixed refrigerant for an LNG production plant prior to start-up of the LNG production plant.

26 Claims, 3 Drawing Sheets

PRODUCTION OF ETHANE FOR START-UP OF AN LNG TRAIN

FIELD

The present invention relates to a process of producing a selected quantity of ethane for use in a production inventory of mixed refrigerant in a process for liquefying a gaseous, methane-rich feed to obtain a liquefied product known as "liquefied natural gas" or "LNG". The present invention relates particularly though not exclusively to a process for producing ethane from a lean natural gas feed stream.

BACKGROUND

Numerous systems exist in the prior art for the liquefaction of a hydrocarbon feed stream by heat exchange with one or more refrigerants such as propane, propylene, ethane, ethylene, methane, nitrogen or combinations of the preceding refrigerants which are referred to in the art as "mixed refrigerant" systems. Examples of liquefaction processes using mixed refrigerants are given in U.S. Pat. No. 5,832,745, U.S. Pat. No. 6,389,844, U.S. Pat. No. 6,370,910 and U.S. Pat. No. 7,219,512 (the contents of which are hereby specifically incorporated by reference). As methods and systems for liquefying a hydrocarbon stream are well known in the art, they do not form a portion of the present invention and thus the operating conditions of the refrigeration side and the compositions of the refrigerants are not discussed in detail here.

A typical mixed refrigerant stream may is nominally 50% ethane, 25% propane, 25% methane and 1-5% nitrogen depending on the operating temperature of the main cryogenic heat exchanger. The methane and the nitrogen are used to cool the top of the cold tube bundle. The ethane provides the majority of the cooling that takes place in the middle of the tube bundles, with the propane providing the cooling duty for the lower portion of the warm bundle at the bottom of the main cryogenic heat exchanger. During normal LNG production operations, the mixed refrigerant circulates between the main cryogenic heat exchanger and a mixed refrigerant compression circuit. At first start-up of an "empty" LNG plant e.g. at a new or "greenfield" site, there is no mixed refrigerant available at site. Propane can be readily purchased and imported to a greenfield site but this is not the case for ethane.

The traditional way of producing ethane for the start-up of an LNG production plant is fill up the propane circuit with imported propane and then run a natural gas feed stream through a scrub column to extract ethane by providing cooling to the top of the scrub column by operating the propane circuit. The natural gas feed stream is run through the scrub column at a reduced rate of between 30 and 40% of the normal operating flow rate for the natural gas feed stream that would be used if the plant was producing LNG. The liquids that drop out in the scrub column are delivered to a fractionation facility including a deethaniser to recover ethane that is stored in a sphere until sufficient ethane has been recovered to supply the required amount of ethane needed for the mixed refrigerant inventory of the LNG plant. Using this prior art process, several weeks of operation may be required to produce a sufficient inventory of ethane for start-up because the extraction efficiency of the scrub column for ethane is around 5%. During this period of time, significant quantities of the gas are flared. In addition to this, running the pipeline or trunkline that delivers a wet natural gas feed stream to the LNG production plant at low velocities causes significant liquid management issues. Compounding the problem, the load on the propane compression circuit is low, requiring the use of recycle valves to keep the propane compressors operational. The recycle stream is warmer than ambient temperature, reducing the efficiency of propane compression. Whilst this prior art process is used for natural gas feed streams that are rich in ethane, an alternative process is needed to handle natural gas feed streams that are lean.

It has been suggested to attempt to start-up an LNG production plant using a mixture of propane and methane without ethane at all. However, this prior art process can only work if the main heat exchanger is capable of being operated at low flow rates in the order of 10 to 15% of the normal LNG production design flow rate. Under normal LNG production operating conditions, natural gas is fed into the bottom of a plurality of vertically oriented tubes within the shell of the main heat exchanger with the liquefied gas that is drawn out of the main heat exchanger passing vertically up the tubes. When an attempt is made to operate the main heat exchanger at a low rate, there is insufficient flowing pressure drop across the tubes of the main heat exchanger to force the liquid out of the top of the tubes. Consequently, when operated at low flow rates, there is a risk of the liquefied gas flowing backwards down the tubes under the influence of gravity. When this occurs, the majority of the tubes fill up with liquid whereby the flowing pressure drop in the remaining tubes is sufficient to force the liquid out of the top. The temperature profile becomes unstable with resulting increases in the mechanical stresses on the main heat exchanger vessel. It is unlikely that production in excess of 50% of design can be achieved with such a mixture of refrigerants.

It is also known to import ethylene in isotainers as a substitute for ethane. However, ethylene has different blast properties to ethane which can result in safety issues unless the plant is specifically designed to run on ethylene from the outset. Using ethylene requires the use of higher separation distances between equipment items requiring a change of layout, a less compact footprint, and consequently an additional cost to construction for a "one-off" usage at start-up.

There remains a need for an alternative method for the production of ethane for starting up an LNG production plant.

SUMMARY

According to a first aspect of the present invention there is provided a process for the production of a selected quantity of ethane as a component of a production inventory of mixed refrigerant for an LNG production plant prior to start-up of the LNG production plant, the LNG production plant using a propane pre-cooled mixed refrigerant process for liquefaction after start-up, the LNG production plant including a liquefaction facility comprising a main heat exchanger, a propane refrigerant facility and a mixed refrigerant facility, wherein i) the propane refrigerant facility includes a first compression stage, one or more intermediate compression stages and a final compression stage, wherein the final compression stage is the coldest stage of the propane refrigerant facility; and, ii) the main heat exchanger has a cold end and a warm end, wherein a wall of the main heat exchanger defines a shell side within which is arranged a warm tube bundle having a warm end and a cold end, and, a cold tube bundle having a warm end and a cold end, wherein the warm tube bundle is arranged toward the warm end of the main heat exchanger and the cold tube bundle is arranged toward the cold end of the main heat exchanger, and, wherein the main cryogenic heat exchanger includes a shell side circuit and a plurality of tube side circuits including, a natural gas tube side circuit, a heavy mixed refrigerant tube side circuit, and, a light mixed refrigerant tube side circuit; the process comprising the steps of:

a) circulating a pre-cooled gas through the liquefaction facility to produce a precooled liquefaction facility;

b) directing a bypass stream of dry sweet scrubbed gas through the light mixed refrigerant circuit of the pre-cooled liquefaction facility at a first mass flow rate to fill the pre-cooled liquefaction facility with the bypass stream;

c) running one or more of the compressors in the mixed refrigerant circuit to compress the bypass stream of dry sweet scrubbed gas and produce a pressurized bypass gas stream;

d) cooling the pressurized bypass gas stream using the propane refrigeration circuit to produce a cooled pressurized bypass gas stream;

e) circulating the cooled pressurized bypass gas stream through the light mixed refrigerant circuit of the main heat exchanger whereby the cooled pressurized bypass gas is cooled as it expands across an expansion valve into the shell side circuit of the main heat exchanger;

f) repeating step e) to progressively cool the cooled pressurized bypass stream to form a fully condensed cooled liquid bypass stream;

g) evaporating the cooled liquid bypass stream in the shell side circuit of the main heat exchanger to produce a first fraction rich in nitrogen and methane and a second fraction rich in ethane, propane, butane and the heavy hydrocarbons;

h) flaring a mass flow rate of the first fraction from the cold end of the main heat exchanger;

i) adjusting a mass flow rate of the bypass stream of step b) to compensate for the mass flow rate of the first fraction being flared in step h);

j) directing the second fraction to flow out of the warm end of the shell side circuit into the bypass stream being fed to the mixed refrigerant circuit in step to produce an ethane-saturated pressurized bypass stream; and, k) cooling the ethane-saturated pressurized bypass stream in the propane refrigerant circuit to produce a condensed heavy mixed refrigerant stream containing liquid ethane for storage in a buffer storage vessel.

In one form, the process further comprises the step of directing a portion of the condensed heavy mixed refrigerant stream containing liquid ethane into the second tube side circuit of the main heat exchanger to progressively fill the second tube side circuit with the condensed heavy mixed refrigerant stream containing liquid ethane. In one form, the process further comprises the step of running the propane refrigerant circuit to produce the pre-cooled gas of step a). In one form, the pre-cooled gas is circulated at temperature in the range of −35 to −40° C. In one form, the pre-cooled gas is a portion of the bypass stream. In one form, the pre-cooled gas is a stream of pre-cooled gas from a fractionation facility or a scrubbing facility.

In one form, the LNG production plant includes a scrubbing facility for receiving a dry sweet gas stream and removing hydrocarbons other than methane to produce a dry scrubbed sweet gas stream, and the method includes the steps of: (i) pre-cooling the dry sweet gas stream using an intermediate stage of the propane refrigerant circuit to produce a pre-cooled dry sweet gas stream; ii) scrubbing the pre-cooled dry sweet gas stream to produce a bottoms liquid product stream enriched in hydrocarbons heavier than methane and an overhead gaseous product stream; and (iii) cooling the overhead gaseous product stream using the coldest stage of the propane refrigerant circuit to produce a dry sweet scrubbed gas stream, a portion of which is used as the bypass stream. In one form, the step of splitting the dry sweet scrubbed gas stream into a flared stream having a first mass flow rate and the bypass stream having a second mass flow rate. In one form, the ratio of the first mass flow rate of the flared stream to the second mass flow rate of the bypass stream is in the range of 5:1 to 2:1. In one form, the ratio of the first mass flow rate of the flared stream to the second mass flow rate of the bypass stream is 4:1 or 3:1.

In one form, the bottoms liquid product stream is directed to a fractionation facility including a de-ethaniser to produce a recovered ethane stream that is directed to an ethane storage facility. In one form, the fractionation facility includes one or both of a depropaniser to produce a recovered propane stream, and a de-butaniser to produce a recovered butane stream.

In one form, the method further comprises the step of directing a circulating stream of the condensed heavy mixed refrigerant stream to circulate through an additional cooling stage downstream of the coldest stage of the plurality of stages of the propane refrigeration circuit.

In one form, the LNG production plant is an onshore or floating LNG production plant.

BRIEF DESCRIPTION OF THE DRAWINGS

In order to facilitate a more detailed understanding of the nature of the invention embodiments of the present invention will now be described in detail, by way of example only, with reference to the accompanying drawings, in which.

DETAILED DESCRIPTION

Figure 1:
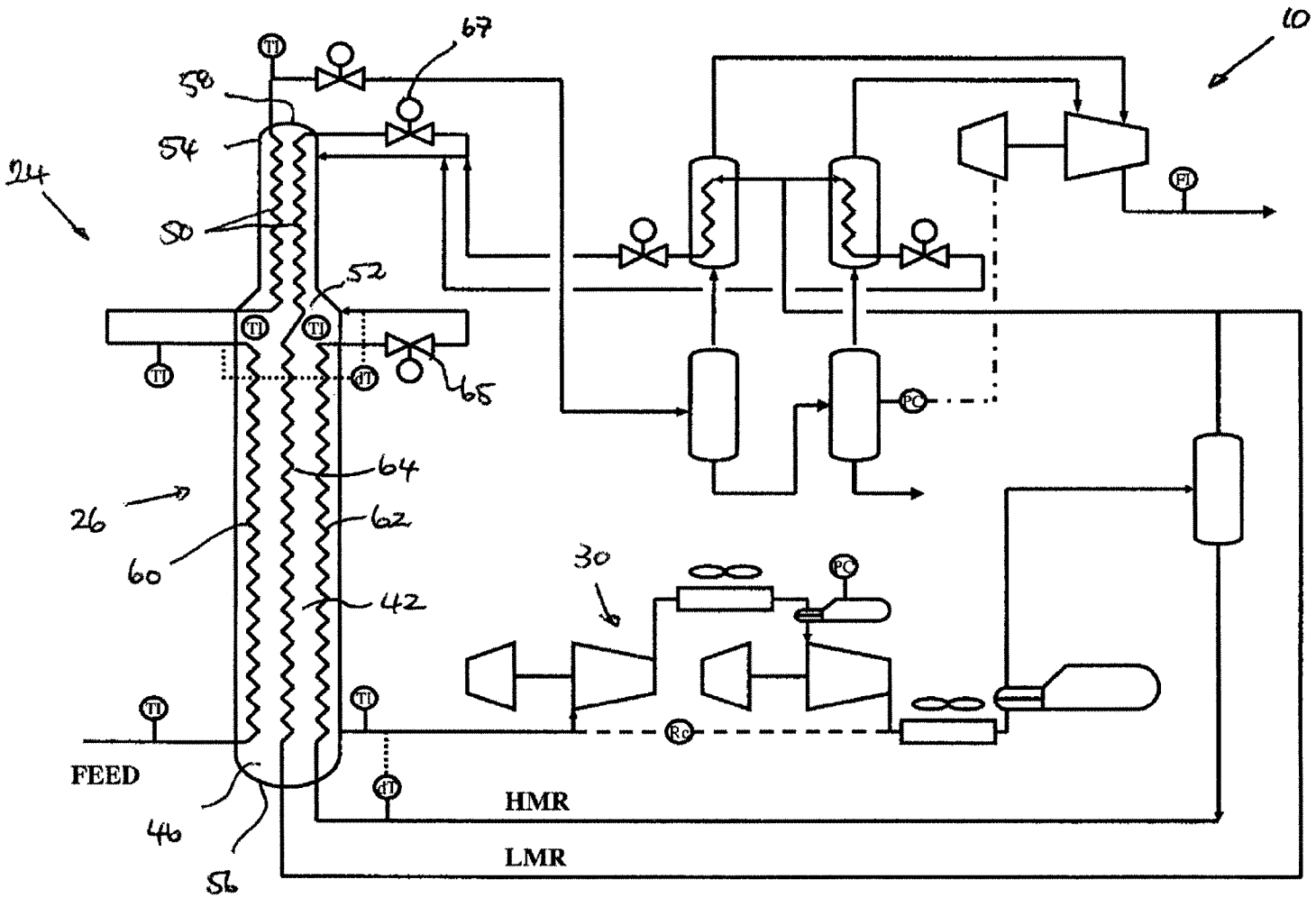
FIG. 1 is a schematic flow chart of a propane pre-cooled mixed refrigerant liquefaction facility for use in producing LNG.

Particular embodiments of the process and apparatus of the present invention are now described by way of example only. The terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs. In the drawings, it should be understood that like reference numbers refer to like parts.

Depending on the source, a methane-rich natural gas feed stream may contain varying amounts of hydrocarbons that are heavier than methane ("C1"), such as ethane ("C2"), propane ("C3"), butane ("C4"), pentane ("C5"), and the so-called "heavy hydrocarbons" ("C5+"). The hydrocarbon gas stream may also contain undesirable non-hydrocarbon contaminants such as H2O, mercury, CO2, H2S, mercaptans, and other organosulphur compounds.

Figure 2:
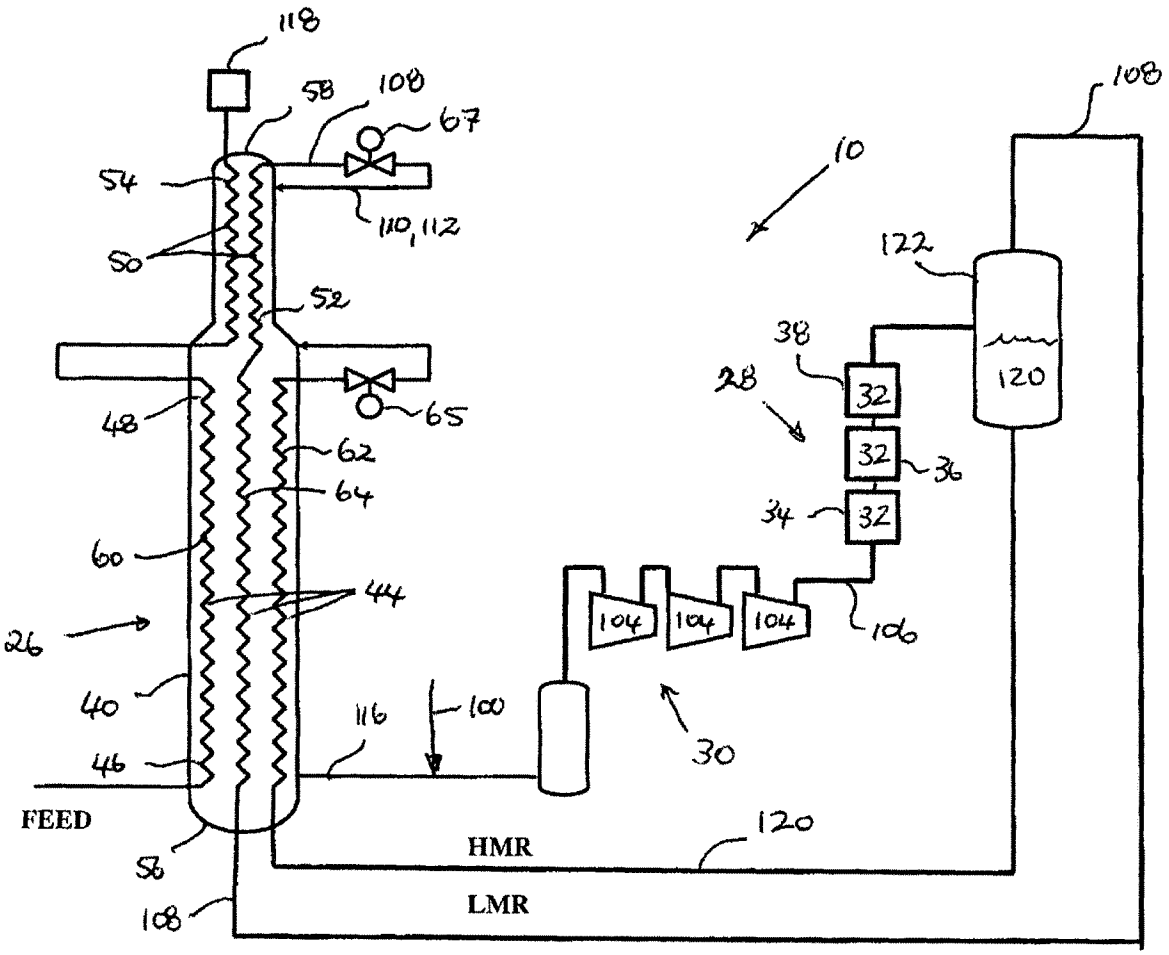
FIG. 2 is a schematic flow chart of the liquefaction facility of FIG. 1 being used for the production of ethane; and, FIG. 3 is a schematic flow chart of a scrubbing facility and associated fractionation facility for producing the bypass gas stream in an embodiment of the present invention.
Figure 3:
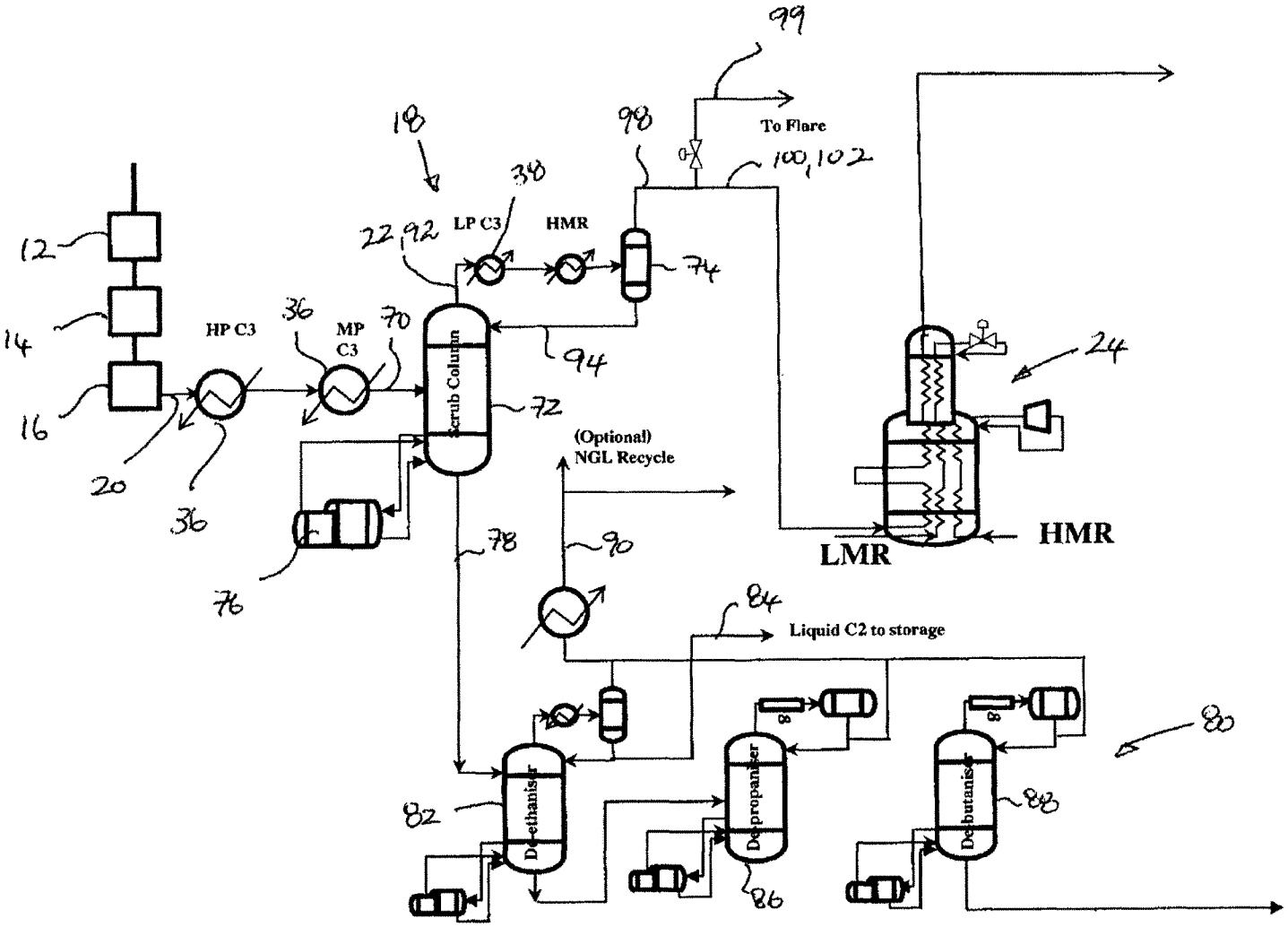

Reference is now made to FIG. 1 and FIG. 3 which illustrates schematically an LNG production plant (10) for the production of LNG using a propane pre-cooled mixed refrigerant process of the type that is described in U.S. Pat. No. 6,272,882. The LNG production plant (10) includes gas processing facilities in the form of an acid gas removal facility (12) for removal of acid gas contaminants, a dehydration facility (14) for removal of water, and a mercury removal facility (16) for removal of mercury. To the extent that these gas processing pre-treatment steps are well known to the person skilled in the art, they do not form a portion of the present invention and are not further discussed here. The LNG production plant (10) includes a scrubbing facility (18) for receiving a dry sweet gas stream (20) and removing hydrocarbons heavier than butane to produce a dry scrubbed sweet gas stream (22) which has had sufficient contaminants removed so that it can be used as a feed stream for a liquefaction facility (24). The liquefaction facility (24) includes a main heat exchanger (26), a propane refrigerant facility (28) and a mixed refrigerant facility (30). The propane refrigerant facility (28) includes a plurality of stages (32) including a first stage (34), one or more intermediate stages (36) and a final stage (38), the final stage being configured to be the coolest stage of the propane refrigerant facility. A wall (40) of the main heat exchanger (26) defines a shell side circuit (42) within which is arranged two tube bundles, being a warm tube bundle (44) having a warm end (46) and a cold end (48) and a cold tube bundle (50) having a warm end (52) and a cold end (54). The warm tube bundle (44) is arranged toward the warm end (56) of the main heat exchanger (26) and the cold tube bundle (50) is arranged toward the cold end (58) of the main heat exchanger (26). In the embodiment illustrated in FIG. 1 and FIG. 2, the main heat exchanger has only two bundles but the present invention is equally applicable to a main heat exchanger has a different plurality of tube bundles, for example, a three-bundle main heat exchanger.

In normal LNG production operation, the feed stream to the liquefaction facility is subjected to pre-cooling using the propane refrigerant circuit before being supplied at elevated pressure to a first tube side of a main heat exchanger at its warm end. The feed stream is cooled, liquefied and sub-cooled against evaporating mixed refrigerant to obtain a liquefied stream of LNG. The liquefied stream is removed from the main heat exchanger at its cold end and passed to storage as liquefied LNG. Evaporated mixed refrigerant is removed from the shell side of the main heat exchanger at its warm end. The evaporated mixed refrigerant is compressed in at least one refrigerant compressor to obtain high-pressure mixed refrigerant. The high-pressure mixed refrigerant is partly condensed and the partly condensed mixed refrigerant is separated into a liquid heavy mixed refrigerant fraction and a gaseous light mixed refrigerant fraction. The heavy mixed refrigerant fraction is sub-cooled in a second tube side of the main heat exchanger to get a sub-cooled heavy mixed refrigerant stream. The heavy mixed refrigerant stream is introduced at reduced pressure into the shell side of the main heat exchanger at an intermediate point with the heavy mixed refrigerant stream being allowed to evaporate in the shell side of the main heat exchanger. At least part of the light mixed refrigerant fraction is cooled, liquefied and sub-cooled in a third tube side of the main heat exchanger to get a sub-cooled light mixed refrigerant stream. This light mixed refrigerant stream is introduced at reduced pressure into the shell side of the main heat exchanger at its cold end, and the light mixed refrigerant stream is allowed to evaporate in the shell side.

It is apparent from the description provided above that the tube side of the main heat exchanger has three tube side circuits, each tube side circuit being required to handle a different stream during normal LNG production operations. More specifically, a gaseous, methane-rich feed stream enters the warm end of a first tube side circuit (60), referred to in the art as "the natural gas circuit" or "NG circuit", as a gas at elevated pressure, condenses as it travels through the first tube side circuit (60), and leaves the cold end of the first tube side circuit as a sub-cooled liquefied stream. A heavy mixed refrigerant fraction enters the warm end of a second tube side circuit (62), referred to in the art as "the heavy mixed refrigerant circuit" or "HMR circuit", as a liquid, is sub-cooled as it travels through the second tube side circuit, and leaves the cold end of the second tube side circuit (62) as a sub-cooled heavy mixed refrigerant stream. At least a part of the light mixed refrigerant fraction enters the warm end of a third tube side circuit (64), referred to in the art as "the light mixed refrigerant circuit" or the "LMR circuit", as a vapour, is cooled, liquefied and sub-cooled as it travels through the third tube side circuit, and leaves the cold end of the third tube side circuit as a sub-cooled light mixed refrigerant stream. At the same time, during normal LNG production operations, the shell side circuit (42) of the main heat exchanger (26) is required to handle: a) a heavy mixed refrigerant stream which has been expanded through an expansion device (65) such as a Joule-Thompson valve ('J-T valve') and enters the shell side at an intermediate location (at the cold end (48) of the warm tube bundle (44), and which is evaporated within the shell side circuit (42) before being removed as a gas from the shell side circuit at its warm end (56); and, b) a light mixed refrigerant stream which has been expanded through an expansion device (67) such as a Joule-Thompson valve ('J-T valve') such that the light mixed refrigerant stream enters the shell side circuit at reduced pressure at the cold end (54) of the cold tube bundle (50), and which is evaporated within the shell side circuit (46) before being removed as a gas from the shell side circuit (46) at its warm end (56).

Under normal operating conditions the LNG production plant of FIG. 1 circulates a production inventory of mixed refrigerant. The production inventory of mixed refrigerant includes a selected quantity of methane, a selected quantity of ethane, a selected quantity of propane and a selected quantity of nitrogen. The process of the present invention uses the scrubbing facility and the liquefaction facility of the LNG production plant to produce the selected quantity of ethane required for the production inventory of mixed refrigerant for an LNG production plant. The process of the present invention may be used for the first start-up of a new LNG production plant or for a full re-start of an existing fixed or floating LNG production plant that does not have a production inventory of mixed refrigerant or that has less than a production inventory of mixed refrigerant. As described in greater detail below, the process for the production of ethane relies on using the main heat exchanger as a separation device which operates in a similar way as a distillation column whereby the methane and lighter components present in the natural gas feed stream are flared while the ethane and the components that are heavier than methane present in the natural gas feed stream are accumulated. The process for the production of ethane is run until at least the selected quantity of ethane for the production inventory of mixed refrigerant has been produced. Advantageously, the main cryogenic heat exchanger is precooled during the process for the production of ethane with the mixed refrigerant circuit being pre-cooled and pressurized at the end of start-up operations to a point that is analogous to a restart operation conducted when an LNG train trips during normal operation. The process of the present invention provides ethane extraction efficiency of more than 95% and close to 100% which significantly reduces the amount and duration of flaring required during ethane production at start-up and reduces the time required to produce ethane from several weeks to several days.

The process of producing ethane of the present invention is now described in detail with reference to FIG. 2 and FIG. 3 with like reference numerals referring to like parts. It is to be understood that while the third tube side circuit (64) is referred below to as the LMR circuit for clarity (using the term that is best known to the person skilled in the art), the process of the present invention is used to produce the mixed refrigerant inventory of an LNG production plant that does not have a sufficient mixed refrigerant inventory to produce LNG. When the liquefaction facility is being used to produce ethane in the manner described in detail below, the LMR circuit is being used to circulate the bypass stream described below while the HMR circuit is used to store liquid ethane and the NG circuit is shut off until after the selected quantity of ethane required has been produced.

Referring to FIG. 3, the dry sweet gas stream (20) is pre-cooled using one or more intermediate stages (36) of the propane refrigerant circuit (28) to produce a pre-cooled dry sweet gas stream (70). The scrubbing facility (18) of FIG. 2 includes a scrub column (72), a reflux drum (74) and an optional reboiler (76). The scrubbing facility (18) receives the pre-cooled dry sweet gas stream (70) and subjects it to gas scrubbing to remove heavy hydrocarbons. In use, the pre-cooled dry sweet gas stream (70) is directed to flow through the scrub column (72) to produce a bottoms liquid product (78) enriched in hydrocarbons heavier than methane. The bottoms liquid product (78) is directed to a fractionation facility (80) including a de-ethaniser (82) to produce a recovered ethane stream (84) that is directed to an ethane storage facility (not shown). The fractionation facility (80) may further include a de-propaniser (86) to produce a recovered propane stream and a debutaniser (88) to produce a recovered butane stream. A natural gas liquids stream (90) produced in the fractionation facility (80) may sold as liquefied petroleum gas (LPG) or recycled to the dry sweet scrubbed gas stream upstream of the main cryogenic heat exchanger. When the LNG production plant includes a reboiler, the reboiler (76) is used to strip methane out of a portion of the bottoms stream (78) as a gas. The scrub column (72) further produces an overhead gaseous product stream (92) which is subjected to additional cooling using the coldest stage (38) of the plurality of stages of the propane refrigeration circuit (26) to drop out a reflux stream (94) in the reflux drum (74). The reflux stream (94) is returned to the scrub column (72). The primary goal is to provide the maximum available level of pre-cooling to the dry sweet scrubbed gas stream before this stream enters the liquefaction facility which is to be used to produce ethane for use in the production inventory of mixed refrigerant.

The pre-cooled dry sweet scrubbed gas stream (98) produced by the scrubbing facility (18) has been partially de-ethanized but the ethane extraction efficiency is poor because the scrubbing facility is designed to remove pentane and the heavy C5+ hydrocarbons, not ethane. By way of example only, if a 5 kton dry sweet gas stream is caused to flow through the scrub column, only 5% of the ethane present in that stream reports to the scrub column bottoms stream while the remaining 95% of the ethane present reports to the scrub column overhead gas product stream. Using the process of the present invention for the production of ethane, the dry sweet scrubbed gas stream (98) is split downstream of the reflux drum in a flared stream (99) and a bypass stream (100). The ratio of the mass flow rate of the flared stream (99) to the mass flow rate of the bypass stream (100) is determined as function of the maximum mass flow rate of gas that can flow through the pipework and valves of the liquefaction facility (24). By way of example only, the ratio of the mass flow rate of the flared stream to the mass flow rate of the bypass stream may be in the range of 5:1 to 2:1, preferably 4:1 or 3:1. If the pipe capacity or valve capacity in the liquefaction facility is higher, then ratio of the flared stream to the bypass stream can be lower, allowing faster production of ethane.

Using the process of the prior art, all of the dry sweet scrubbed gas stream is flared with the only ethane being recovered from the bottoms product using a de-ethanizer which forms a part of a fractionation facility. Using the process of the present invention, the bypass stream is directed to flow through the liquefaction facility which is then operated in the manner described below to produce ethane instead of LNG. As a precursor to operating the liquefaction facility for ethane production, a pre-cool down operation is performed by circulating a stream of pre-cooled gas (102) using methods that are known to a person skilled in the art for normal start-up operations. The purpose of the pre-cool down operation is to drop the temperature of the liquefaction facility (including the warm tube bundle, the cold tube bundle, and the shell of the main heat exchanger, and the mixed refrigerant circuit) from ambient to the lowest temperature achievable using the propane refrigerant circuit in isolation. The term 'ambient' is used here to describe a temperature in the range of 15 to 30° C., depending on local weather conditions. By way of example, a pre-cool cool temperature in the range of −35 to −40° C. can be achieved using the propane refrigerant circuit of FIG. 2. The pre-cool down operation is completed prior to commencing the production of ethane using the process of the present invention. As a variant on such prior art pre-cool down processes, the bypass stream (100) can be circulated to perform the pre-cool down operation because the bypass stream is a partially de-ethanized overhead product stream that has been cooled to a temperature in the range of −35 to −40° C.

When the pre-cool down operation is complete, the valve configuration in the liquefaction facility (24) is reconfigured to allow the liquefaction facility (24) to be used to produce ethane. In this configuration, first tube side circuit (60) and the second tube side circuit (62) are blanked off while the bypass stream is directed to flow through the third tube side circuit (64). During normal LNG production operations, the operating pressure of the mixed refrigerant compression facility would nominally be around 40 to 50 bar or higher. When the liquefaction facility is being used to produce ethane using the process of the present invention, the discharge pressure of the mixed refrigerant compression facility is much lower, by way of example, only 15 to 20 bar. The reason for this is that the bypass stream (100) being fed to the mixed refrigerant compressors (104) during ethane production is lighter than the normal mixed refrigerant gas inventory that the compressors operate with during LNG production.

The bypass stream (100) is circulated through the third tube side circuit (64) until the third tube side circuit (64) is filled with gas at which time one or more of the compressors (104) in the mixed refrigerant circuit (30) is started up to produce a pressurized bypass gas stream (106). The pressurized bypass gas stream (106) is subjected to cooling by the propane refrigeration circuit (28) to form a cooled pressurized bypass gas stream (108) that is directed to flow through the warm end (46) of the warm tube bundle (44), out of the cold end (48) of the warm tube bundle (44), into the warm end (52) of the cold bundle (50), out of the cold end (54) of the cold bundle (50) and then across the expansion valve (67), such as a J-T valve into the shell side circuit (42) of the main heat exchanger (26). When the cooled pressurized bypass gas stream (108) flashes across the J-T valve (67), a cooler bypass gas stream (110) is formed, the cooler bypass gas stream (110) having a temperature that is has been lowered as a function of the pressure drop across the J-T valve (67) according to the "Joule-Thomson effect". By way of example only, when the pressurized bypass gas stream is a lean gas containing 0.125 mole fraction of nitrogen, 0.813 mole fraction of methane, 0.045 mole fraction of ethane, 0.015 mole fraction of propane and 0.001 mole fraction of i-Butane and n-Butane, with a starting temperature of 35° C., expansion of this gas from 20 bar (g) to 3 bar (g) causes the gas to cool to −48.5° C. If the same gas has a starting temperature of −60° C. and is expanded under the same conditions, it will cool to −77.5° C. If the same gas has a starting temperature of −100° C. and is expanded under the same conditions, it will cool to −129° C.

The cooler bypass gas stream (110) flows into the shell side circuit (42) of the main heat exchanger where it is evaporate to provide cooling to the cooled pressurized bypass gas stream (108) that is flowing through the tubes of the third tube side circuit (64) that are located in the cold bundle (50) at the cold end (58) of the main heat exchanger (26). The cooler bypass gas stream (110) becomes progressively cooled until a partially condensed cooled liquid bypass stream is formed as the pressurized bypass gas stream flashes across the J-T valve. As progressive cooling continues, a fully condensed cooled liquid bypass stream is formed, at which time the mass flow rate of the bypass stream (100) can be increased to increase the rate of production of ethane because the J-T valve can operate at higher flow rates when expanding a liquid instead of a gas.

When the cold bundle (50) has been sufficiently cooled to allow a cooled bypass liquid stream (112) to form, evaporation of the cooled bypass liquid stream provides additional cooling in the main heat exchanger. The lighter fractions present in the cooled bypass liquid stream (112), vaporise at a higher temperature than the heavier fractions. More specifically, a first fraction (114) that is rich in nitrogen and methane vaporises from the cooled bypass liquid stream at a colder temperature than a second fraction (116) that is rich in ethane, propane, butane and the heavy hydrocarbons. The first fraction is allowed to flow up the shell side circuit (42) of the main heat exchanger (26) or out the cold end (54) of the cold bundle (50) to a flare (118). The overall pressure of the mixed refrigerant circuit (30) in the liquefaction facility (18) is regulated by adjusting the ratio of the bypass stream (100) that is continuously fed to the mixed refrigerant circuit (30) with the mass flow rate of the first fraction (114) being flared from the top of the main heat exchanger.

The second fraction (116) which exits the shell side at the warm end (56) of the main heat exchanger (26) as a gas is recirculated through the mixed refrigerant circuit (30) where it is subjected to compression along with the bypass stream of gas (100) that is continuously being fed to the mixed refrigerant circuit (30). Over time, the pressurized bypass stream (100) becomes progressively richer in ethane. When the pressurized bypass stream (106) that is being cooled by the propane cooling circuit (28) becomes saturated in ethane for at a selected pressure and temperature, the ethane (and other hydrocarbons that are heavier than methane) present in the pressurized bypass stream (108) condenses as a condensed heavy mixed refrigerant stream (120) which is collected in a buffer storage vessel (122) that is used during normal LNG production to store the heavy mixed refrigerant. The condensed heavy mixed refrigerant stream (120) containing liquid ethane is allowed to flow out of the buffer storage vessel (122) into the second tube side circuit (62) pipework. In this way, the second tube side circuit (62) becomes progressively filled with the condensed heavy mixed refrigerant stream (120) containing liquid ethane until such time as the selected quantity of ethane has been produced, allowing LNG production to commence.

Using the process of the present invention, essentially 100% of the ethane in the bypass stream is recovered compared with a 5% extraction efficiency using a scrub column. The increased ethane extraction efficiency is a result of the scrub column performing ethane extraction at an operating temperature of around −35 to −40° C. (being the typical temperature produced by expansion and evaporation of liquid propane at low pressure) whereas the main heat exchanger using the process of the present invention performs the extraction of ethane at an operating temperature of around −100 to −140° C. as produced by expansion and vaporisation of liquid methane at low pressure. At this much lower operating temperature, the efficiency of ethane extraction is 95 to 100%. Using the process of the present invention, sufficient ethane inventory can be produced in a matter of two or three days compared with two or three weeks using the processes of the prior art. It is to be understood that the process of the present invention is used in parallel with the operation of the scrub column to ensure that the ethane inventory is produced as quickly as possible, so that LNG production can commence even sooner.

Further improvements in ethane recovery can be achieved by directing a circulating stream (150) of the condensed heavy mixed refrigerant stream (120) to flow out of the buffer storage vessel (122) and circulate through an additional cooling stage (39) downstream of the coldest stage (38) of the plurality of stages of the propane refrigeration circuit (26) to provide additional cooling for the scrub column (72) so that the dry sweet scrubbed gas stream has been cooled to the lowest possible temperature before this stream enters the liquefaction facility. The circulating stream (150) of heavy mixed refrigerant is brought online to provide this additional cooling as soon as a sufficient quantity of the condensed heavy mixed refrigerant stream (120) has been produced using the process of the present invention described in detail above. The additional cooling provided by the circulating stream (150) improves the extraction efficiency of the scrub column from 5% to an extraction efficiency of 7 to 10%, helping to accelerate ethane recovery. Downstream of the additional cooling stage (39), the evaporated circulating heavy mixed refrigerant stream (150) is returned to the mixed refrigerant circuit (30), increasing the density of the gas flowing to the compressors (104) and providing an advantageous increase in the compression ratio of the compressors which improves ethane recovery into the buffer storage vessel (120) even further.

Now that embodiments of the invention have been described in detail, it will be apparent to persons skilled in the relevant art that numerous variations and modifications can be made without departing from the basic inventive concepts. All such modifications and variations are considered to be within the scope of the present invention, the nature of which is to be determined from the foregoing description and the appended claims.

Each of the patents cited in this specification, are herein incorporated by reference. It will be clearly understood that, although a number of prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed:

1. A process for the production of ethane as a component of a production inventory of mixed refrigerant for a liquefied natural gas (LNG) production plant prior to producing liquefied natural gas (LNG) with the liquefied natural gas (LNG) production plant, the liquefied natural gas (LNG) production plant including a liquefaction facility comprising a main cryogenic heat exchanger (MCHE) and a mixed refrigerant (MR) circuit having a mixed refrigerant (MR) compression stage, a propane refrigerant facility which cools a high pressure side of the mixed refrigerant (MR) compression stage and a mixed refrigerant (MR) accumulator in fluid communication with the mixed refrigerant (MR) compression stage, wherein the main cryogenic heat exchanger (MCHE) includes a shell side circuit and a plurality of tube side circuits including a natural gas (NG) tube side circuit, a heavy mixed refrigerant (HMR) tube side circuit, and a light mixed refrigerant (LMR) circuit including a light mixed refrigerant (LMR) tube side circuit and an expansion valve, the expansion valve being in fluid communication with the light mixed refrigerant (LMR) tube side circuit at a cold end of the main cryogenic heat exchanger (MCHE) to feed an expanded fluid stream from the light mixed refrigerant (LMR) tube side circuit into the main cryogenic heat exchanger (MCHE) shell side circuit, the light mixed refrigerant (LMR) tube side circuit being in fluid communication with the mixed refrigerant (MR) accumulator at a warm end of the main cryogenic heat exchanger (MCHE) to receive a light mixed refrigerant (LMR) vapor from the mixed refrigerant (MR) accumulator; and the HMR heavy mixed refrigerant (HMR) tube side circuit is in fluid communication with the mixed refrigerant (MR) accumulator to receive a bottom heavy mixed refrigerant liquid from the mixed refrigerant (MR) accumulator, the process comprising the steps of:

A) pre-cooling the liquefaction facility to produce a precooled liquefaction facility;

B) blanking off the natural gas (NG) tube side circuit and the heavy mixed refrigerant (HMR) tube side circuit;

C) directing a bypass stream of dry sweet scrubbed gas through the light mixed refrigerant (LMR) circuit at a first mass flow rate to fill the light mixed refrigerant (LMR) tube side circuit with the bypass stream of dry sweet scrubbed gas;

D) after filling the light mixed refrigerant (LMR) tube side circuit, directing the bypass stream to a suction side of the mixed refrigerant (MR) compression stage of the mixed refrigerant (MR) circuit and using the mixed refrigerant (MR) compression stage to compress the bypass stream of dry sweet scrubbed gas and produce a pressurized bypass gas stream which is cooled by the propane refrigerant facility and directed to the mixed refrigerant (MR) accumulator;

E) circulating the pressurized bypass gas stream through the light mixed refrigerant (LMR) circuit and the mixed refrigerant (MR) circuit, to progressively cool, partially condense and ethane-enrich the stream by:

i) feeding vapor from the mixed refrigerant (MR) accumulator through the light mixed refrigerant (LMR) tube side circuit from the warm end of the main cryogenic heat exchanger (MCHE) and subsequently through the expansion valve to cool and partially evaporate any liquid in the stream as it enters the main cryogenic heat exchanger (MCHE) shell side circuit at the cold end of the main cryogenic heat exchanger (MCHE) to form a first fraction rich in nitrogen and methane which is flared from the cold end of the main cryogenic heat exchanger (MCHE), and a second fraction rich in ethane, propane, butane and the heavy hydrocarbons flows through the main cryogenic heat exchanger (MCHE) shell side circuit and cools the bypass stream in the light mixed refrigerant (LMR) tube side circuit by evaporation against the stream in the light mixed refrigerant (LMR) tube side circuit;

ii) feeding the evaporated second fraction into the bypass stream being directed to the mixed refrigerant (MR) circuit in step (D) to produce an ethane-enriched stream wherein the ethane-enriched stream is fed to the suction side of the mixed refrigerant (MR) compression stage to produce a compressed ethane-enriched stream; and iii) cooling the compressed ethane enriched stream in the propane refrigerant facility to produce a partially condensed stream containing liquid ethane and storing a condensed portion containing liquid ethane in the mixed refrigerant (MR) accumulator as a condensed heavy mixed refrigerant stream containing liquid ethane and wherein an uncondensed portion of the ethane-enriched stream in the mixed refrigerant (MR) accumulator forms the vapor used in step (E.i);

F) adjusting the first flow rate of the bypass stream of step (D) to compensate for the mass flow rate of the first fraction being flared in step (E.i); and G) opening the natural gas (NG) tube side circuit and the heavy mixed refrigerant (HMR) tube side circuit to initiate liquefied natural gas (LNG) production when a selected quantity of liquid ethane has accumulated in the mixed refrigerant (MR) accumulator.

2. The process of claim 1 further comprising the step of progressively filling the blanked off heavy mixed refrigerant (HMR) tube side circuit with the condensed heavy mixed refrigerant stream containing liquid ethane.

3. A process for the production of ethane as a component of a production inventory of mixed refrigerant for a liquefied natural gas (LNG) production plant prior to producing liquefied natural gas (LNG) with the liquefied natural gas (LNG) production plant, the liquefied natural gas (LNG) production plant including a liquefaction facility comprising a main cryogenic heat exchanger (MCHE) and a mixed refrigerant (MR) circuit having a mixed refrigerant (MR) compression stage, a propane refrigerant facility which cools a high pressure side of the mixed refrigerant (MR) compression stage and a mixed refrigerant (MR) accumulator in fluid communication with the mixed refrigerant (MR) compression stage, wherein the main cryogenic heat exchanger (MCHE) includes a shell side circuit and a plurality of tube side circuits including a natural gas (NG) tube side circuit, a heavy mixed refrigerant (HMR) tube side circuit, and a light mixed refrigerant (LMR) circuit including a light mixed refrigerant (LMR) tube side circuit and an expansion valve, the expansion valve being in fluid communication with the light mixed refrigerant (LMR) tube side circuit at a cold end of the main cryogenic heat exchanger (MCHE) to feed an expanded fluid stream from the light mixed refrigerant (LMR) tube side circuit into the main cryogenic heat exchanger (MCHE) shell side circuit, the light mixed refrigerant (LMR) tube side circuit being in fluid communication with the mixed refrigerant (MR) accumulator at a warm end of the main cryogenic heat exchanger (MCHE) to receive a light mixed refrigerant vapor from the mixed refrigerant (MR) accumulator; and the heavy mixed refrigerant (HMR) tube side circuit is in fluid communication with the mixed refrigerant (MR) accumulator to receive a bottom heavy mixed refrigerant liquid from the mixed refrigerant (MR) accumulator, the process comprising the steps of:

A) pre-cooling the liquefaction facility to produce a precooled liquefaction facility, wherein the pre-cooling is achieved by running the propane refrigerant circuit to produce a pre-cooled gas and circulating the pre-cooled gas through the liquefaction facility to precool the liquefaction facility;

B) blanking off the natural gas (NG) tube side circuit and the heavy mixed refrigerant (HMR) tube side circuit;

C) directing a bypass stream of dry sweet scrubbed gas through the light mixed refrigerant (LMR) circuit at a first mass flow rate to fill the light mixed refrigerant (LMR) tube side circuit with the bypass stream of dry sweet scrubbed gas;

D) after filling the light mixed refrigerant (LMR) tube side circuit, directing the bypass stream to a suction side of the mixed refrigerant (MR) compression stage of the mixed refrigerant (MR) circuit and using the mixed refrigerant (MR) compression stage to compress the bypass stream of dry sweet scrubbed gas and produce a pressurized bypass gas stream which is cooled by the propane refrigerant facility and directed to the mixed refrigerant (MR) accumulator;

E) circulating the pressurized bypass gas stream through the light mixed refrigerant (LMR) circuit and the mixed refrigerant (MR) circuit, to progressively cool, partially condense and ethane-enrich the stream by:

i) feeding vapor from the mixed refrigerant (MR) accumulator through the light mixed refrigerant (LMR) tube side circuit from the warm end of the main cryogenic heat exchanger (MCHE) and subsequently through the expansion valve to cool and partially evaporate any liquid in the stream as it enters the main cryogenic heat exchanger (MCHE) shell side circuit at the cold end of the main cryogenic heat exchanger (MCHE) to form a first fraction rich in nitrogen and methane which is flared from the cold end of the main cryogenic heat exchanger (MCHE), and a second fraction rich in ethane, propane, butane and the heavy hydrocarbons flows through the main cryogenic heat exchanger (MCHE) shell side circuit and cools the bypass stream in the light mixed refrigerant (LMR) tube side circuit by evaporation against the stream in the light mixed refrigerant (LMR) tube side circuit;

ii) feeding the evaporated second fraction into the bypass stream being directed to the mixed refrigerant (MR) circuit in step (D) to produce an ethane-enriched stream wherein the ethane-enriched stream is fed to the suction side of the mixed refrigerant (MR) compression stage to produce a compressed ethane-enriched stream; and iii) cooling the compressed ethane enriched stream in the propane refrigerant facility to produce a partially condensed stream containing liquid ethane and storing a condensed portion containing liquid ethane in the mixed refrigerant (MR) accumulator as a condensed heavy mixed refrigerant stream containing liquid ethane and wherein an uncondensed portion of the ethane-enriched stream in the mixed refrigerant (MR) accumulator forms the vapor used in step (E.i); and F) adjusting the first flow rate of the bypass stream of step (D) to compensate for the mass flow rate of the first fraction being flared in step (E.i).

4. The process of claim 3 wherein the pre-cooled gas is circulated at temperature in the range of −35 to −40° C.

5. The process of claim 3 wherein the pre-cooled gas is a portion of the bypass stream.

6. The process of claim 3 wherein the pre-cooled gas is a stream of pre-cooled gas from a fractionation facility or a scrubbing facility.

7. The process of claim 1 wherein the liquefied natural gas (LNG) production plant includes a scrubbing facility for receiving a dry sweet gas stream and removing hydrocarbons other than methane to produce a dry scrubbed sweet gas stream, and the method includes the steps of:

(i) pre-cooling the dry sweet gas stream using an intermediate stage of the propane refrigerant facility to produce a pre-cooled dry sweet gas stream;

(ii) scrubbing the pre-cooled dry sweet gas stream to produce a bottoms liquid product stream enriched in hydrocarbons heavier than methane and an overhead gaseous product stream; and (iii) cooling the overhead gaseous product stream using the propane refrigerant facility to produce the dry sweet scrubbed gas stream, a portion of which is used as the bypass stream of dry sweet scrubbed gas.

8. The process of claim 7 including the step of splitting the dry sweet scrubbed gas stream into a flared stream having a first mass flow rate and the bypass stream of dry sweet scrubbed gas having a second mass flow rate.

9. The process of claim 8 wherein the ratio of the first mass flow rate of the flared stream to the second mass flow rate of the bypass stream of dry sweet scrubbed gas is in the range of 5:1 to 2:1.

10. The process of claim 8 wherein the ratio of the first mass flow rate of the flared stream to the second mass flow rate of the bypass stream of dry sweet scrubbed gas is 4:1 or 3:1.

11. The process of claim 7 wherein the bottoms liquid product stream is directed to a fractionation facility including a de-ethaniser to produce a recovered ethane stream that is directed to an ethane storage facility.

12. The process of claim 10 wherein the fractionation facility includes one or both of a de-propaniser to produce a recovered propane stream, and a de-butaniser to produce a recovered butane stream.

13. The process of claim 7 further comprising the step of directing a circulating stream of the condensed heavy mixed refrigerant stream to an additional cooling stage downstream of the propane refrigeration facility to provide additional cooling to a scrubbing column which facilitates the scrubbing and wherein the condensed heavy mixed refrigerant is evaporated to form an evaporated fraction of the heavy mixed refrigerant.

14. The process of claim 1 wherein the liquefied natural gas (LNG) production plant is an onshore or floating liquefied natural gas (LNG) production plant.

15. The process of claim 2 further comprising the step of running the propane refrigerant circuit to produce a precooled gas and circulating the pre-cooled gas through the liquefaction facility to achieve step A).

16. The process of claim 15 wherein the pre-cooled gas is circulated at temperature in the range of −35 to −40° C.

17. The process of claim 15 wherein the pre-cooled gas is a portion of the bypass stream of sweet dry scrubbed gas.

18. The process of claim 15 wherein the pre-cooled gas is a stream of pre-cooled gas from a fractionation facility or a scrubbing facility.

19. The process of claim 2 wherein the liquefied natural gas (LNG) production plant includes a scrubbing facility for receiving a dry sweet gas stream and removing hydrocarbons other than methane to produce a dry scrubbed sweet gas stream, and the method includes the steps of:

(i) pre-cooling the dry sweet gas stream using an intermediate stage of the propane refrigerant facility to produce a pre-cooled dry sweet gas stream;

(ii) scrubbing the pre-cooled dry sweet gas stream to produce a bottoms liquid product stream enriched in hydrocarbons heavier than methane and an overhead gaseous product stream; and (iii) cooling the overhead gaseous product stream using the propane refrigerant facility to produce a dry sweet scrubbed gas stream, a portion of which is used as the bypass stream of sweet dry scrubbed gas.

20. The process of claim 19 including the step of splitting the dry sweet scrubbed gas stream into a flared stream having a first mass flow rate and the bypass stream of sweet dry scrubbed gas having a second mass flow rate.

21. The process of claim 20 wherein the ratio of the first mass flow rate of the flared stream to the second mass flow rate of the bypass stream of sweet dry scrubbed gas is in the range of 5:1 to 2:1.

22. The process of claim 20 wherein the ratio of the first mass flow rate of the flared stream to the second mass flow rate of the bypass stream of sweet dry scrubbed gas is 4:1 or 3:1.

23. The process of claim 19 wherein the bottoms liquid product stream is directed to a fractionation facility including a de-ethaniser to produce a recovered ethane stream that is directed to an ethane storage facility.

24. The process of claim 19 wherein the fractionation facility includes one or both of a de-propaniser to produce a recovered propane stream, and a de-butaniser to produce a recovered butane stream.

25. The process of claim 15 further comprising the step of directing a circulating stream of the condensed heavy mixed refrigerant stream to circulate through an additional cooling stage downstream of the coldest stage of the propane refrigeration circuit.

26. The process claim 15 wherein the liquefied natural gas (LNG) production plant is an onshore or floating liquefied natural gas (LNG) production plant.

* * * * *